US010487452B1

(12) United States Patent
Qin et al.

(10) Patent No.: US 10,487,452 B1
(45) Date of Patent: Nov. 26, 2019

(54) TREATED FIBERS AND FIBROUS STRUCTURES COMPRISING THE SAME

(71) Applicant: Kimberly-Clark Worldwide, Inc., Neenah, WI (US)

(72) Inventors: Jian Qin, Appleton, WI (US); Youquan Su, Shanghai (CN); Liyi Shi, Shanghai (CN)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 17 days.

(21) Appl. No.: 16/070,640

(22) PCT Filed: Jan. 16, 2018

(86) PCT No.: PCT/US2018/013780
§ 371 (c)(1),
(2) Date: Jul. 17, 2018

(87) PCT Pub. No.: WO2018/140251
PCT Pub. Date: Aug. 2, 2018

Related U.S. Application Data

(60) Provisional application No. 62/450,630, filed on Jan. 26, 2017.

(51) Int. Cl.

| | |
|---|---|
| ***D21H 11/20*** | (2006.01) |
| ***D21C 9/00*** | (2006.01) |
| ***D21C 9/18*** | (2006.01) |
| ***D21H 17/63*** | (2006.01) |
| ***D21H 17/59*** | (2006.01) |
| ***D21H 27/40*** | (2006.01) |
| ***D21H 27/00*** | (2006.01) |
| ***D21H 27/34*** | (2006.01) |

(52) U.S. Cl.
CPC ..... *D21H 11/20* (2013.01); *D21C 9/004* (2013.01); *D21C 9/005* (2013.01); *D21C 9/18* (2013.01); *D21H 17/59* (2013.01); *D21H 17/63* (2013.01); *D21H 27/005* (2013.01); *D21H 27/34* (2013.01); *D21H 27/40* (2013.01)

(58) Field of Classification Search
CPC ..... D21H 17/675; D21H 17/70; D21H 17/64; D21H 27/002; D21H 17/59; D21H 17/63; D21H 21/22; D21H 23/04; D21H 11/20; D21H 27/30; D21H 27/005; D21C 9/004; D21C 9/18
See application file for complete search history.

(56) References Cited

U.S. PATENT DOCUMENTS

| | | | | | |
|---|---|---|---|---|---|
| 4,469,746 | A | | 9/1984 | Weisman | |
| 4,510,020 | A | * | 4/1985 | Green | D21C 9/004 162/169 |
| 4,940,513 | A | | 7/1990 | Spendel | |
| 5,048,589 | A | | 9/1991 | Cook | |
| 5,122,230 | A | * | 6/1992 | Nakajima | D06M 11/11 162/157.1 |
| 5,129,988 | A | | 7/1992 | Farrington | |
| 5,275,699 | A | * | 1/1994 | Allan | D21H 17/70 162/181.2 |
| 5,300,192 | A | | 4/1994 | Hansen | |
| 5,399,412 | A | | 3/1995 | Sudall | |
| 5,427,844 | A | | 6/1995 | Murai | |
| 5,432,000 | A | | 7/1995 | Young | |
| 5,449,551 | A | | 9/1995 | Taniguchi | |
| 5,494,554 | A | | 2/1996 | Edwards | |
| 5,552,020 | A | | 9/1996 | Smith | |
| RE35,460 | E | * | 2/1997 | Klungness | D21C 9/004 162/9 |
| 5,665,205 | A | * | 9/1997 | Srivatsa | D21H 17/70 162/158 |
| 5,679,220 | A | * | 10/1997 | Matthew | D21H 17/70 162/158 |
| 5,725,736 | A | | 3/1998 | Schroeder | |
| 5,928,470 | A | * | 7/1999 | Shannon | D21C 9/005 162/100 |
| 6,030,675 | A | | 2/2000 | Schroeder | |
| 6,296,737 | B1 | * | 10/2001 | Wu | A61L 15/18 162/158 |
| 6,358,365 | B1 | | 3/2002 | Zhang | |
| 6,387,212 | B1 | * | 5/2002 | Christian | D21H 17/70 162/181.2 |
| 6,413,365 | B1 | * | 7/2002 | Doelle | B01F 7/00758 162/158 |
| 6,706,148 | B1 | | 3/2004 | Joisson | |
| 7,175,741 | B2 | | 2/2007 | West | |
| 8,808,503 | B2 | * | 8/2014 | Klungness | D21C 9/004 162/181.2 |
| 2001/0021453 | A1 | | 9/2001 | Hansen | |
| 2003/0056917 | A1 | | 3/2003 | Jimenez | |
| 2004/0065422 | A1 | | 4/2004 | Hu | |
| 2006/0060320 | A1 | * | 3/2006 | Doelle | D21H 21/285 162/162 |

(Continued)

FOREIGN PATENT DOCUMENTS

| | | | | |
|---|---|---|---|---|
| CA | 2280043 A1 | * | 8/1998 | D21C 9/004 |
| EP | 0996787 A1 | | 5/2000 | |

(Continued)

*Primary Examiner* — Jose A Fortuna

(74) *Attorney, Agent, or Firm* — Kimberly-Clark Worldwide, Inc.

(57) ABSTRACT

The present invention provides a treated fiber having reduced hydrogen bonding capabilities, which may be useful in the production of tissue products having improved bulk and softness. The treated fiber comprises a water-insoluble inorganic compound that is generated in situ by reacting at least one compound selected from the group consisting of a silicate, a silyl, a silane, and an alkaline metal and a precipitation agent in the presence of the fiber at or above the critical fiber consistency.

16 Claims, 2 Drawing Sheets

(56) References Cited

U.S. PATENT DOCUMENTS

2006/0113051 A1* 6/2006 Dolle ..... D21C 9/004 162/181.2
2006/0243405 A1 11/2006 Zwick
2007/0131360 A1* 6/2007 Sipila ..... D21H 17/70 162/9
2007/0137808 A1 6/2007 Lostocco
2007/0151681 A1* 7/2007 Doelle ..... D21H 17/675 162/9
2007/0269626 A1 11/2007 Rueckert
2009/0056888 A1* 3/2009 Doelle ..... D21H 17/70 162/10
2009/0126891 A1 5/2009 Koivunen
2010/0212853 A1* 8/2010 Klungness ..... D21C 9/004 162/181.4
2011/0061827 A1 3/2011 Virtanen
2014/0174686 A1* 6/2014 Yang ..... D21C 1/04 162/202
2014/0178660 A1* 6/2014 Kim ..... D21H 21/22 428/219
2014/0360693 A1* 12/2014 Klungness ..... D21C 9/004 162/181.2
2015/0176222 A1* 6/2015 Lindsay ..... D21H 27/40 162/111
2015/0218758 A1* 8/2015 Qin ..... D21H 17/74 162/60
2016/0010283 A1 1/2016 Jogikalmath
2016/0024717 A1* 1/2016 Lindsay ..... D21H 11/20 162/127
2016/0040361 A9* 2/2016 Klungness ..... D21C 9/004 162/181.2
2017/0107668 A1* 4/2017 Fukuoka ..... D21H 19/385

FOREIGN PATENT DOCUMENTS

WO WO9105106 A1 4/1991
WO WO9717494 A1 5/1997
WO WO9813549 A1 4/1998
WO WO9828491 A1 7/1998
WO WO-9835095 A1 * 8/1998 ..... D21C 9/004
WO WO06058273 A2 6/2006
WO WO07003697 A1 1/2007
WO WO07025095 A1 3/2007
WO WO11120875 A1 10/2011
WO WO15083227 A1 6/2015
WO WO15152283 A1 10/2015
WO WO-2018140251 A1 * 8/2018 ..... D21H 11/20
WO WO-2018140252 A1 * 8/2018 ..... D21H 11/20

* cited by examiner

TREATED FIBERS AND FIBROUS STRUCTURES COMPRISING THE SAME

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet the level of lint and slough is inversely proportional to the tensile strength of the sheet. Lint and slough can generally be defined as the tendency of the fibers in the paper web to be rubbed from the web when handled.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers. Bleached Kraft fibers typically contain only about 2-3 milliequivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force. Thus, there remains a need in the art for fiber treatments and treated fibers that positively affect the strength and softness of the resulting fibrous structure, without the limitations typically associated with the use of chemical additives such as deboning agents.

SUMMARY

It has now been surprisingly discovered that the strength and softness of a fibrous structure may be altered by at least partially forming the structure from treated fiber comprising a water-insoluble inorganic. The modified fibrous structure properties are the result of the treated fibers decreased ability to hydrogen bond with other fibers. The ability of a fiber to hydrogen bond with other fibers is altered by treating the fiber with a water-insoluble inorganic compound, where the water-insoluble inorganic compound is formed in situ by reacting silicate, a silyl, a silane, or an alkaline metal and a precipitation agent in the presence of the fiber at or above its critical fiber consistency. To sufficiently inhibit the hydrogen bonding capability of the fiber and, in-turn, modify the physical properties of a fibrous structure formed from the same, it is important that the precipitation agent be added at or above the critical fiber consistency.

Hence in one aspect, the present invention provides a method for treating a fiber, such as wood pulp fiber, with a water-insoluble inorganic compound, the method comprising the steps of dispersing fiber in water to form a fiber slurry, adding at least a first reagent selected from the group consisting of a silicate, a silyl, a silane, and an alkaline metal to the fiber slurry, thereby forming a modified fiber slurry, partially dewatering the modified fiber slurry to a consistency of at least about 15 percent and adding a precipitation agent to the partially dewatered modified fiber slurry to form and water-insoluble inorganic in situ which results in a treated fiber comprising the water-insoluble inorganic.

In another embodiment, the method comprises creating a fiber slurry comprising water and fibers, such as wood pulp fibers, having a consistency of about 15 percent or greater and more preferably greater than about 20 percent and still more preferably greater than about 30 percent, such as from about 15 to about 85 percent and more preferably from about 20 to about 50 percent. A water-soluble compound is applied to the fiber slurry, thereby forming a modified fiber slurry. A precipitation agent is then added to the modified fiber slurry and reacted with the water-soluble compound to form a water-insoluble inorganic compound that is deposited on the fiber to form a treated fiber. The process may further include dewatering of the treated fiber, thereby forming a crumb-form formation of the treated fiber which may subsequently be dispersed in water to form a treated fiber slurry useful in the manufacture of tissue webs and products.

In yet another embodiment, the present invention provides a method of manufacturing a treated fiber comprising the steps of providing a fiber slurry having a consistency equal to, or greater than, about 15 percent; adding a first reagent selected from the group consisting of a silicate, a silyl, a silane, and an alkaline metal to the fiber slurry, and adding a precipitation agent to the fiber slurry to form a treated fiber comprising a water-insoluble inorganic.

Preferably the methods of the present invention yield a treated fiber, such as a treated wood pulp fiber, that comprises from about 5,000 to about 20,000 ppm water-insoluble inorganic. For example, in certain embodiments, the invention provides a treated fiber comprising from about 5,000 to about 20,000 ppm silicon dioxide. In other embodiments the treated fiber may comprises from about 5 to about 20 mg of water-insoluble inorganic per kilogram of fiber, such as from about 8 to about 20 mg/kg and more preferably from about 10 to about 20 mg/kg. When dispersed in water, the slurry of treated fiber may be used in a process to produce a fibrous structure where the presence of the water-insoluble inorganic compound inhibits inter-fiber bonding and modifies the at least one physical property of the resulting fibrous structure.

In another aspect, the present invention provides a method for applying water-insoluble inorganic compounds to the pulp fiber during the pulp processing stage. During the pulp processing stage, upstream of a paper machine, one can obtain treated pulp fibers according to the present invention. Furthermore, the treated pulp fiber can be transported to several different paper machines that may be located at various sites, and the quality of the finished product from each paper machine will be more consistent. Also, by treating the pulp fiber before the pulp fiber is made available for use on multiple paper machines or multiple runs on a paper machine, the need to install equipment at each paper machine for the water-insoluble inorganic addition can be eliminated. Thus, another aspect of the present invention is a uniform supply of treated pulp fiber, replacing the need for costly and variable chemical treatments at one or more paper machines.

In yet another aspect, the present invention provides a treated pulp fiber and slurries comprising the same, where the amount of water-insoluble inorganic retained by the treated fibers is about 2.0 kilograms per metric ton or greater. In particularly desirable embodiments, the amount of retained water-insoluble inorganic is at least about 2.0 kg/metric ton, such as from about 2.0 to about 20 kg/metric ton and more preferably from about 5.0 to about 20 kg/metric ton. Once the treated fibers are redispersed at the paper machine, the amount of unretained water-insoluble inorganic in the process water phase is from about 0 and about 10 percent, more particularly from about 0 and about 5.0 percent, and still more particularly from about 0 and about 2.5 percent, of the amount of water-insoluble inorganic retained by the pulp fibers.

In still other aspects, the present invention provides a method for making fibrous structures comprising treated fibers where the fibrous structures differ in at least one physical parameter, such as sheet bulk, relative to a comparable fibrous structure substantially free of treated fiber. The method comprising mixing modified pulp fibers with water to form a treated fiber slurry. The treated fiber slurry is formed into a wet fibrous web. When formed into a slurry the treated fibers have retained from between about 40 to about 100 percent, such as from about 50 to about 80 percent, of the water-insoluble inorganic. The wet fibrous web is then dried and converted into a finished product having enhanced qualities due to the treated fibers.

Thus, in certain embodiments the present invention provides a method of increasing the bulk of a tissue web comprising the steps of dispersing fiber in an aqueous solvent to form a fiber slurry, adding a first reagent selected from the group consisting of a silicate, a silyl, a silane, and an alkaline metal to the fiber slurry, partially dewatering the fiber slurry to a consistency equal to, or greater than, about 15 percent to form a partially dewatered fiber slurry, adding a precipitation agent to the partially dewatered fiber slurry to form a treated fiber comprising a water-insoluble inorganic, and forming a tissue web from the treated fiber, wherein the tissue web has a sheet bulk greater than about 5.0 cc/g and a basis weight less than about 60 gsm.

In yet other embodiments the present invention provides a tissue product comprising at least one multi-layered tissue web having a first fibrous layer, a second fibrous layer, and a third fibrous layer, the first and third fibrous layers comprising untreated cellulosic fibers and the second fibrous layer comprising treated fiber comprising at least about 5,000 ppm water-insoluble inorganic selected from silicone, aluminum and zinc, wherein the treated fiber comprises at least about 5 percent of the total weight of the multi-layered web.

DEFINITIONS

Figure 1:
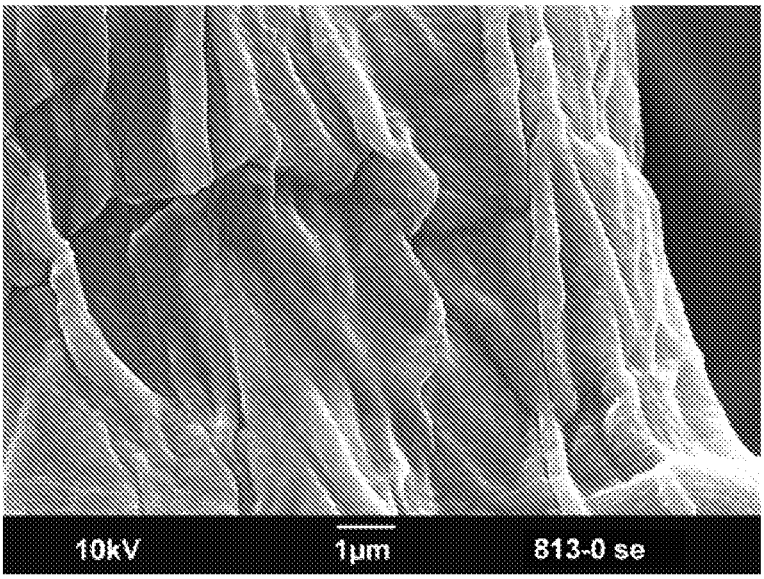
FIG. 1 is a SEM micrograph of an untreated hardwood kraft fiber.

As used herein the term "fiber" refers to an elongate particulate having an apparent length greatly exceeding its apparent width, i.e. a length to diameter ratio of at least about 10. More specifically, as used herein, fiber refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly and more particularly wood pulp fibers.

As used herein the term "slurry" refers to a mixture comprising fibers and water.

As used herein the term "critical fiber consistency" generally refers to the consistency of a fiber slurry at which a substantial portion of the water is held by intra-fiber voids and pores, but not by inter-fiber gaps and interphase.

As used herein the term "water-soluble" refers to the ability of an inorganic compound or complex of the present invention to remain in solution. Generally the water-soluble compounds of the present invention form an aqueous solution and do not form a precipitate when mixed with water. Further, the solutions should be essentially colorless and clear. In this regard, the aqueous solutions of water-soluble compounds of the present invention appear clear.

As used herein the term "water-insoluble" generally refers to inorganic compounds and complexes of the present invention that form a precipitate and do not remain in an aqueous solution at 25° C. Further, water-insoluble compounds and complexes may be separated from the aqueous phase by most physical or mechanical separation techniques, such as centrifugation, sedimentation, or filtration.

As used herein the term "fibrous structure" generally refers to a structure, such as a sheet, that comprises a plurality of fibers. In one example, a fibrous structure according to the present invention means an orderly arrangement of fibers within a structure in order to perform a function. Nonlimiting examples of fibrous structures of the present invention include paper, fabrics (including woven, knitted, and non-woven), and absorbent pads (for example for diapers or feminine hygiene products).

Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fiber slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a tissue product.

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "geometric mean tensile" (GMT) refers to the square root of the product of the machine direction tensile and the cross-machine direction tensile of the web, which are determined as described in the Test Methods section.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g).

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slope generally is expressed in units of kg/3" or g/3".

As used herein, the term "Stiffness Index" refers to the quotient of the geometric mean slope (having units of g/3") divided by the geometric mean tensile strength (having units of g/3").

As used herein the term "substantially free" refers to a layer of a tissue that has not been formed with the addition of treated fiber. Nonetheless, a layer that is substantially free of treated fiber may include de minimus amounts of treated fiber that arise from the inclusion of treated fibers in adjacent layers and do not substantially affect the softness or other physical characteristics of the tissue web.

DETAILED DESCRIPTION

The present invention provides a treated fiber having reduced hydrogen bonding capabilities. The treated fiber formed in accordance with the present invention may be useful in the production of tissue products having improved bulk and softness. More importantly, the treated fiber is adaptable to current tissue making processes and may be incorporated into a tissue product to improve bulk and softness without an unsatisfactory reduction in tensile. The fiber formed in accordance with the invention is fiber, such as a wood pulp fiber, comprising a water-insoluble inorganic compound that inhibits the ability of the fiber to hydrogen bond with other fibers. The water-insoluble inorganic compound is generated in situ by reacting at least one compound selected from the group consisting of a silicate, a silyl, a silane, and an alkaline metal and a precipitation agent in the presence of the fiber at or above the critical fiber consistency. Upon generation, the water-insoluble inorganic compound is deposited on the fiber where it may inhibit the fiber's ability to hydrogen bond with other fibers.

Accordingly, in certain embodiments the present invention provides a treated fiber having reduced hydrogen bonding capabilities. The treated fiber formed in accordance with the present invention may be useful in the production of fibrous structures, and more particularly tissue products, having improved bulk and softness. More importantly, the treated fiber is adaptable to a wide range of fibrous structure manufacturing processes, including both air-laid and wet-laid processes, and as such may be useful in the production of a broad range of structures having improved properties, such as improved bulk and softness without an unsatisfactory reduction in tensile.

The effect of treated fibers of the present invention on the physical properties of fibrous structures comprising the same, will vary depending on a range of factors including, for example, the method used to manufacture the fibrous structure, the degree of fiber modification, the amount of treated fiber incorporated in the fibrous structure and the manner in which the treated fiber is incorporated in the fibrous structure. Thus, in one embodiment, it may be desirable to affect the degree of modification so as to moderate the hydrogen bonding between fibers. Preferably the degree to which the water-insoluble inorganic compound inhibits hydrogen bonding between fibers is sufficient to enhance bulk and softness of a resulting fibrous structure, but not so significant as to negatively affect its tensile strength. For example, preferably the treated fiber increases sheet bulk by at least about 25 percent, more preferably at least about 40 percent and still more preferably at least about 50 percent, such as from about 25 to about 100 percent, while only decreasing the tissue product's tensile index by less than about 25 percent, and more preferably by less than about 20 percent and still more preferably by less than about 10 percent.

Fibers suitable for modification include natural or cellulosic fibers, such as wood fibers including, for example, hardwood and softwood fibers, and non-wood fibers including, for example, cotton fibers. In one particularly preferred embodiment, wood fibers and more particularly wood pulp fibers are used as a starting material for preparing the treated fibers of the present invention. Wood pulp fibers may be formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers includes hardwood fibers, such as, but not limited to, eucalyptus, maple, birch, aspen, and the like. In certain instances, eucalyptus fibers may be particularly desired to increase the softness of the web. Eucalyptus fibers can also enhance the brightness, increase the opacity, and change the pore structure of the tissue product to increase its wicking ability. Moreover, if desired, secondary fibers obtained from recycled materials may be used, such as fiber pulp from sources such as, for example, newsprint, reclaimed paperboard, and office waste.

The chemical composition of the treated fiber of the invention depends, in part, on the extent of processing of the fiber from which the treated fiber is derived. In general, the treated fiber of the invention is derived from a wood fiber that has been subjected to a pulping process (i.e., a wood pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a treated wood pulp fiber comprising lignin, cellulose, hemicellulose and a water-insoluble inorganic compound.

Generally the water-insoluble inorganic compound may comprise a metal selected from the silicon, aluminum and zinc, or combinations thereof. The water-insoluble inorganic compound is generally formed in situ and deposited on the fiber thereby inhibiting fiber-fiber bonding. Preferably a high degree of water-insoluble inorganic is retained on the fiber when the fiber is dispersed in water. For example, at least about 40 percent of the water-insoluble inorganic, and more preferably at least about 45 percent and still more preferably at least about 50 percent, such as from about 40 to about 100 percent, is retained when the fiber is dispersed in water. Accordingly, in certain embodiments, the amount of water-insoluble inorganic retained by the fiber may be at least about 1,000 ppm and more preferably 5,000 ppm and still more preferably at least about 9,000 ppm, such as from about 5,000 to about 50,000 ppm. The amount of retained water-insoluble inorganic may be assessed by well-known analytical techniques such as, for example, inductively coupled plasma spectroscopy (ICP) and more particularly ICP optical emission spectroscopy (ICP-OES).

Figure 2A:
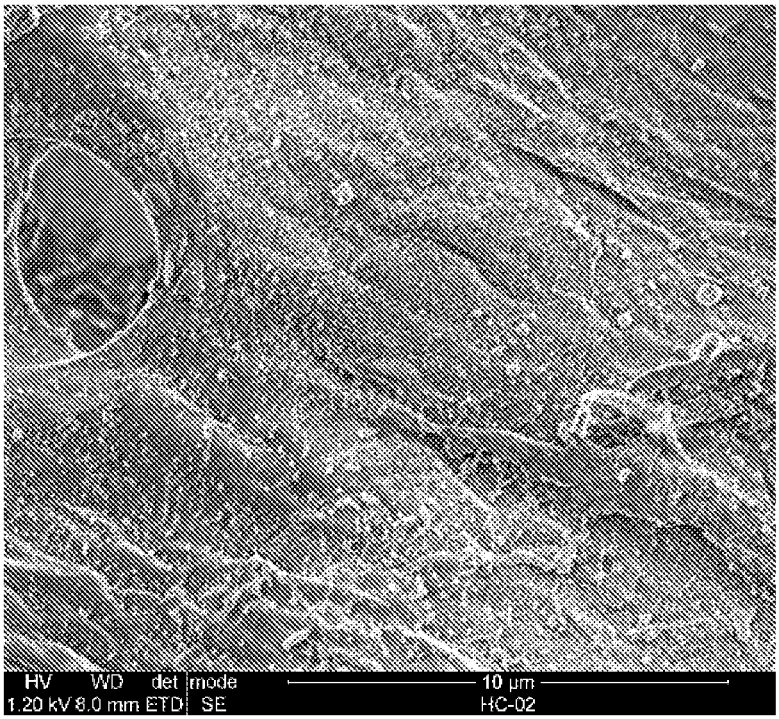
FIGS. 2A and 2B are SEM micrographs of treated hardwood kraft fiber.
Figure 2B:
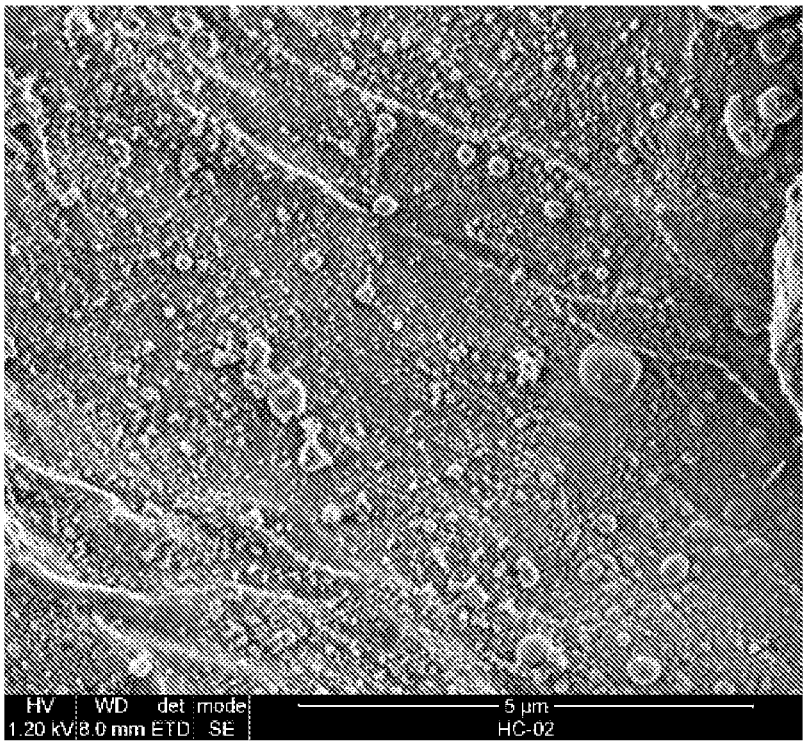

Generally the water-insoluble inorganic portion of the treated fiber of the present invention results from reacting at least one compound selected from the group consisting of a silicate, a silyl, a silane, and an alkaline metal and a precipitating agent in the presence of the fiber at or above the critical fiber consistency. Treatment of fibers in this manner generally results in a fiber comprising a water-insoluble inorganic and having reduced ability to participate in hydrogen bonding with other fibers. For example, as shown in FIGS. 2A and 2B, the treated fiber comprises a water-insoluble inorganic deposited on the fiber surface while the untreated (FIG. 1) fiber is substantially free from any particles on its surface. The extent of deposition on the fiber surface and the size of the inorganic deposits may vary depending on the fiber, the resulting water-insoluble inorganic compound or complex, as well as the reaction conditions, however, in certain embodiments the deposits may have an average particle diameter less than about 200 nanometers, and more preferably less than about 150 nanometers and still more preferably less than about 100 nanometers.

In certain embodiments, the inorganic compound or complex may be deposited on the fiber surface in a relatively uniform manner and act as a barrier to prevent hydrogen bonds from being formed between the fibers. At the same time, due to its rigid nature, the inorganic compound or complex may increase the fiber's modulus. In certain embodiments treated fibers have relatively uniform distribution of silicon whereas the untreated fibers are substantially free from silicon. The distribution of a given inorganic compound on the fiber surface may be measured using a scanning electron microscope having single beams with different angles in the far field.

As noted previously, formation of a treated fiber generally results by reacting at least one compound, generally referred to hereinafter as the first reagent, selected from the group consisting of a silicate, a silyl, a silane, and an alkaline metal and a precipitating agent in the presence of the fiber at or above the critical fiber consistency. In one particularly preferred embodiment the first reagent is a water-soluble compound having a water solubility of greater than about 100 mg/mL and more preferably greater than about 200 mg/mL and still more preferably greater than about 500 mg/mL, when measured at 25° C. The water solubility of the first reagent provides the advantage of simplifying the modification process, reducing costs and improving reaction yields of treated fibers.

The water-soluble compound may be organic or inorganic. Suitable water-soluble compounds include silicates and alkaline metals including alkaline earth metals. In certain preferred embodiments the water-soluble compound is a silicate selected from the group consisting of sodium silicate, potassium silicate, lithium silicate and quaternary ammonium silicates. In one particularly preferred embodiment the water-soluble compound comprises a silicate and more preferably alkaline metal silicates such as sodium silicate, potassium silicate or lithium silicate, and combinations thereof. For example, sodium silicates useful in the present invention may have a $SiO:Na_2O$ ratio between about 2:1 to about 4:1 and more preferably from about 2:1 to about 2.85:1.

In other embodiments the first reagent is a silane compound, such as tetraethoxysilane (TEOS), or a silyl, such as trimethylsilyl isocyanate. In a particularly preferred embodiment the first reagent is a silane and more particularly an alkoxysilane. Particularly useful alkoxysilane include a class of materials commonly referred to as "sol-gel," as described in a recent review article by Ciriminna et al. (Chem. Rev. (2013), 113 (8), pp 6592-6620. The alkoxysilane provides reactive silyl groups that can be hydrolyzed in the presence of small amounts of water to form compounds having silanol (SiOH) groups that may be further reacted to form —Si—O—Si— linkages, thereby forming a crosslinked matrix. The alkoxysilane has a formula of Si(OR)4, wherein R is an alkyl group. The alkoxy portion (i.e., —OR) of the alkoxysilane contains from 1 to about 12 carbon atoms, from 1 to about 8 carbon atoms, or from 1 to about 4 carbon atoms. The alkoxy group can be straight or branched. In embodiments, the hydrolyzable alkoxysilane includes tetramethoxysilane, tetraethoxysilane (TEOS), tetrapropoxysilane, tetraisopropoxy silane, or combinations thereof.

Further, in certain embodiments, where the first reagent is a silane compound, the silane compound may be dissolved in an organic solvent. Suitable organic solvents may include, for example, alcohols, cellosolves such as methyl cellosolve, ethyl cellosolve, butyl cellosolve and cellosolve acetate, ketones such as acetone and methyl ethyl ketone, and ethers such as dioxane and tetrahydrofuran. Preferred are alcohols such as, for example, methanol, ethanol, isopropanol and butanol.

Suitable precipitation agents may vary depending upon the first reagent. For example, where the first reagent is an alkaline earth metal silicate, such as sodium silicate, the precipitation agent may be an acid, an acid forming compound, ammonium salts, or sodium aluminate. In those embodiments where the water-soluble compound is an alkaline earth silicate, particularly preferred precipitation agents are acids and more preferably inorganic acid, such as hydrochloric acid and sulfuric acid.

In other embodiments, where the first reagent is a silane compound, such as tetraethoxysilane (TEOS), the precipitation agent may be water, or may be a basic substance. Suitable basic substances include, for example, ammonia, dimethylamine and diethylamine. In a particularly preferred embodiment the first reagent is tetraethoxysilane (TEOS) and the precipitation agent is ammonia.

A variety of suitable processes may be used to generate fibers comprising water-insoluble inorganic, which is generally referred to herein as "treated fibers." Possible modification processes include any synthetic method(s) which may be used to associate the water-insoluble inorganic compound with the fibers. More generally, the treatment of fibers according to the present invention may use any process or combination of processes which promote or cause the generation of a treated fiber. For example, in certain embodiments the fiber is first reacted with a first reagent to form a modified fiber, the modified fiber may be partially dewatered to at least about the critical fiber consistency followed by reaction with a precipitation agent to form a water-insoluble inorganic compound and ultimately a treated fiber.

While a treated fiber may be created by sequentially treating the fiber with a first reagent and then a precipitating agent, the invention is not so limited. In other embodiments the fiber is first reacted with a precipitation agent and then with a first reagent to form a water-insoluble inorganic compound and ultimately a treated fiber. In still other embodiments, the first reagent and a precipitation agent may be added simultaneously to the fiber to generate a treated fiber. Regardless of the order of addition of the first reagent and the precipitation agent, it is important that the consistency of the fiber is at or above the critical fiber concentration when the precipitation agent is added to the fiber. In this manner the water-insoluble inorganic compound that is formed in situ upon mixing of the first reagent and the precipitation agent is deposited on the fiber and retained thereby, effectively inhibiting its ability to participate in hydrogen bonding.

While the order of addition is generally non-limiting, in certain preferred embodiments it may be beneficial to separate the addition of the first reagent and the precipitation agent to obtain the treated fiber of the present invention. For example, in certain embodiments, the addition of the first reagent and the precipitation agent are separated from one another by at least about 5 minutes, such as from about 5 to about 10 minutes and more preferably from about 5 to about 20 minutes. Between the addition of the first reagent and the addition of the precipitation agent it may be preferable to mix the fiber slurry.

Generally fiber treatment may be carried out at a variety of fiber consistencies at or above the critical fiber consistency. For example, in one embodiment treatment is carried out at a fiber consistency greater than about 15 percent, more preferably greater than about 20 percent, such as from about 15 to about 85 percent and more preferably from about 20 to about 60 percent and still more preferably from about 30 to about 50 percent. In those embodiments where the first reagent is added to the fiber slurry prior to addition of the precipitation agent it is particularly preferred that modification be carried out at a fiber consistency greater than about 15 percent, such as from about 15 to about 40 percent, so as to limit hydrolysis of the reagent or the resulted water-insoluble precipitate remaining in water phase in the inter-fiber space.

The amount of the first reagent will vary depending on the type of fiber, the desired degree of treatment and the desired physical properties of the fibrous structure formed with treated fibers. However, by reacting the first reagent and the precipitating agent in the presence of fiber at or above the critical fiber consistency, the amount of first reagent required to provide a treated fiber having inhibited hydrogen bonding is greatly as reduced. Thus, the amount of the first reagent may generally be less than about 100 percent and more preferably less than about 60 percent and still more preferably less than about 50 percent, based on the dry weight of the fiber. Accordingly, in certain embodiments the mass ratio of dried fiber to the first reagent is from about 1:0.05 to about 1:1, more preferably from about 1:0.05 to about 1:0.5 and still more preferably from about 1:0.1 to about 1:0.3. As such, the weight percentage of the first reagent, based upon dried fiber, is generally about 100 percent or less, such as from about 5 to about 100 percent and more preferably from about 5 to about 50 percent and more preferably from about 10 to about 30 percent.

In certain preferred embodiments, the first reagent compound is a metal silicate which is added at a dosage from about 100 to 1,000 pounds per metric ton (based on SiO2 and the dry weight of the fiber) more preferably from about 100 to 600 lbs/ton, and still more preferably from about 100 to 400 lbs/ton.

Preferably reaction of the first reagent and the precipitation agent in the presence of the fiber results in the treated fiber slurry having a neutral pH, such as a pH from about 6.8 to about 7.2. Further, the reaction conditions, such as time, temperature and pH may be modified to obtain the desired degree of treatment. Accordingly, in certain embodiments, the treatment according to the invention can be carried at a temperature from about 0 about 100° C., such as from about 20 to about 70° C. In certain embodiments the treatment time at 20° C. may range from about 5 minutes to 5 hours, such as from about 5 minutes to 3 hours, and in a particularly preferred embodiment from about 5 minutes to 1 hour.

Generally after formation of the water-insoluble inorganic compound as a result of reacting the first reagent and the precipitation agent, the water-insoluble inorganic compound is deposited on the fiber and retained thereon. Water-insoluble inorganic that is not retained on the fiber may be removed from the fiber slurry by washing. After washing, the amount of water-insoluble inorganic retained by the fiber may be assessed by well-known analytical techniques such as, for example, inductively coupled plasma spectroscopy (ICP) and more particularly ICP optical emission spectroscopy (ICP-OES). Accordingly, in one embodiment the treated fiber comprises at least about 1,000 ppm and more preferably 5,000 ppm and still more preferably at least about 9,000 ppm, such as from about 5,000 to about 50,000 ppm, metal selected from the group consisting of silicon, aluminum and zinc, or combinations thereof.

In certain embodiments the treated fiber may be subjected to further treatment by dispersing the treated fiber in water, partially dewatering the fiber to at least the critical fiber consistency and then reacting the fiber with a second reagent and a precipitating agent. For example, in one embodiment, a treated fiber prepared by reacting fiber with a silicate or an alkaline metal and having a fiber consistency of at least about 15 percent may be provided and then reacted with a second reagent, such as a silane, and a precipitating agent. In a particularly preferred embodiment a treated fiber having a fiber consistency of at least about 15 percent may be provided and then mixed with a silane compound, such as tetraethoxysilane (TEOS), and then a precipitation agent, which may be water or a basic substance, such as ammonia or sodium hydroxide.

After formation, and optionally washing, the treated fibers may be dried. The consistency of the dried treated fibers may range from about 65 to about 100 percent. In other embodiments, the consistency of the dried treated fiber may range from about 80 to about 100 percent or from about 85 to about 95 percent.

The dried treated fiber may be redispersed in an aqueous solvent, such as water, to form a fiber slurry useful in the manufacture of fibrous structures. Preferably the treated fiber retains at least about 40 percent of the water-insoluble inorganic, and more preferably at least about 45 percent and still more preferably at least about 50 percent, such as from about 40 to about 100 percent, when the treated fibers are redispersed in water.

When redispersed in water, the treated fibers of the present invention may be used to form a fibrous structure and more specifically a wet-laid web, such as a tissue web. When forming tissue webs from the treated fibers of the present invention, it is generally preferred that no additional inorganic fillers such as titanium dioxide, clay calcium carbonate, calcium sulphate, and the like, are added, either in the wet end of tissue formation or as a post-treatment to the formed tissue. The use of such fillers in tissue products typically increases the abrasiveness and stiffness of the tissue products while decreasing their softness. Furthermore, the foregoing inorganic fillers may leave a residue further disadvantaging the use of such fillers.

Rather than add an inorganic filler to the furnish or to the tissue web after formation or by post-treatment, it is generally preferred that inorganic matter be introduced to the tissue web by use of a treated fiber according to the present invention. The introduction of inorganic compounds to the tissue web in this manner overcomes the limitations of using traditional fillers as the treated fibers generally do not stiffen the sheet and are not abrasive. In fact, in certain instances the treated fibers may actually reduce the stiffness of the web and improve other important physical properties, such as sheet bulk. Moreover, the use of treated fibers may simplify the tissue manufacturing process as no retention aids are necessary to retain the inorganic material in the tissue web as it is already associated with the fiber and is retained at high levels.

When forming tissue webs from treated fiber, the tissue web may comprise from about 0.1 to about 100 percent, more preferably from about 1.0 to about 70 percent and still more preferably from about 5.0 to about 50 percent and still more preferably from about 10 to about 30 percent, based upon the weight of the web, treated fibers. The amount of treated fiber incorporated into the web may vary depending on a number of different factors including, for example, the method of web manufacturing, the desired properties of the resulting web and the intended end use of the web.

While the amount of treated fiber used in the formation of fibrous structures according to the present invention may vary, it is generally preferred that treated fiber be incorporated in an amount sufficient to improve at least one physical property of the structure. For example, when forming tissue webs and products it may be desirable to add a sufficient amount of treated fiber to improve the sheet bulk while decreasing the stiffness of the web or product.

In particularly preferred embodiments the effect on one or more structure properties may be controlled by selectively depositing the treated fibers in one or more layers of the structure. For example, the inventors have discovered that the increase in bulk and decrease in stiffness is most acute when the treated fibers are selectively incorporated into a single layer of a multi-layered web, and particularly the middle layer of a three layered web. Webs produced in this manner not only display a surprising increase in bulk, but also produce webs having reduced stiffness without a significant deterioration in strength. Typically adding treated fibers to the center layer would decrease bonding and significantly decrease strength. To lessen this effect, one skilled in the art would typically blend or add treated fibers to the outer layers. Here however, the most beneficial use of treated fibers is in the middle layer of a multi-layered web.

Although based upon their inability to participate in hydrogen bonding the treated fibers would not appear to be a suitable replacement for wood fibers, and particularly softwood fibers that customarily constitute a large percentage of the center layer of a multi-layered tissue web, it has now been discovered that by selectively incorporating treated fibers into a multi-layered web, even in amounts up to 100 percent by weight of the center layer, these negative effects may be minimized. Even more surprising is that modified hardwood pulp fibers may be used in the middle-layer of a multi-layered web without a deleterious effect.

Accordingly, in one embodiment the present disclosure provides a multi-layered tissue web comprising treated fibers selectively disposed in one or more layers, wherein the tissue layer comprising treated fibers is adjacent to a layer comprising untreated fiber and which is substantially free from untreated fiber. In a particularly preferred embodiment the web comprises three layers where treated fibers are disposed in the middle layer and the first and third layers are substantially free from treated fibers. However, it should be understood that the tissue product can include any number of plies or layers and can be made from various types of pulp and treated fibers. The tissue webs may be incorporated into tissue products that may be either single or multi-ply, where one or more of the plies may be formed by a multi-layered tissue web having cotton selectively incorporated in one of its layers.

Regardless of the exact construction of the tissue product, at least one layer of a multi-layered tissue web incorporated into the tissue product comprises treated fibers, while at least one layer comprises unmodified papermaking fibers. Suitable papermaking fibers may comprise wood pulp fibers formed by a variety of pulping processes, such as kraft pulp, sulfite pulp, thermomechanical pulp, etc. Further, the wood fibers may have any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood fibers include hardwood fibers, such as, but not limited to, eucalyptus, maple, birch, aspen, and the like, which can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

The layer comprising treated fiber may be formed entirely from treated fiber or may consist essentially of a blend of treated and untreated fibers. In one embodiment, treated fibers have a silicon content of at least about 1,000 ppm, and more preferably at least about 5,000 ppm, such as from about 5,000 to about 50,000 ppm, are incorporated into a single layer of a multi-layered web where the treated layer comprises greater than about 2.0 percent, by weight of the layer, treated fiber, such as from about 2.0 to about 40 percent and more preferably from about 5.0 to about 30 percent. In a particularly preferred embodiment the treated fibers are incorporated in the web in a manner to increase the web's sheet bulk and reduce the sheet's stiffness.

Webs that include the treated fibers can be prepared in any one of a variety of methods known in the web-forming art. In a particularly preferred embodiment treated fibers are incorporated into tissue webs formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

In one embodiment the web is formed by a process commonly referred to as conventional wet-pressed using couch forming, wherein two wet web layers are independently formed and thereafter combined into a unitary web. To form the first web layer, untreated fibers are prepared in a manner well known in the papermaking arts and delivered to the first stock chest, in which the fiber is kept in an aqueous suspension. A stock pump supplies the required amount of suspension to the suction side of the fan pump. Additional dilution water also is mixed with the fiber suspension.

To form the second web layer, treated and untreated fibers may be mixed together and delivered to the second stock chest, in which the fiber is kept in an aqueous suspension. A stock pump supplies the required amount of suspension to the suction side of the fan pump. Additional dilution water is also mixed with the fiber suspension. The entire mixture is then pressurized and delivered to a headbox. The aqueous suspension leaves the headbox and is deposited onto an endless papermaking fabric over the suction box. The suction box is under vacuum which draws water out of the suspension, thus forming the second wet web. In this example, the stock issuing from the headbox is referred to as the "dryer side" layer as that layer will be in eventual contact with the dryer surface. In some embodiments, it may be desired for a layer containing the synthetic and pulp fiber blend to be formed as the "dryer side" layer.

After initial formation of the first and second wet web layers, the two web layers are brought together in contacting relationship (couched) while at a consistency of from about 10 to about 30 percent. Whatever consistency is selected, it is typically desired that the consistencies of the two wet webs be substantially the same. Couching is achieved by bringing the first wet web layer into contact with the second wet web layer at roll.

After the consolidated web has been transferred to the felt at the vacuum box, dewatering, drying and creping of the consolidated web is achieved in the conventional manner. More specifically, the couched web is further dewatered and transferred to a dryer (e.g., Yankee dryer) using a pressure roll, which serves to express water from the web, which is absorbed by the felt, and causes the web to adhere to the surface of the dryer.

The wet web is applied to the surface of the dryer by a press roll with an application force of, in one embodiment, about 200 pounds per square inch (psi). Following the pressing or dewatering step, the consistency of the web is typically at or above about 30 percent. Sufficient Yankee dryer steam power and hood drying capability are applied to this web to reach a final consistency of about 95 percent or greater, and particularly 97 percent or greater. The sheet or web temperature immediately preceding the creping blade, as measured, for example, by an infrared temperature sensor, is typically about 250° F. or higher. Besides using a Yankee dryer, it should also be understood that other drying methods, such as microwave or infrared heating methods, may be used in the present invention, either alone or in conjunction with a Yankee dryer.

At the Yankee dryer, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer is immediately following the creping doctor blade, permitting sufficient time for the spreading and drying of the film of fresh adhesive.

The dried web is removed from the Yankee dryer by the creping blade and the creped tissue web may be subjected to further converting to produce a tissue product, which may be single or multi-plied. For instance, in one aspect, a single ply wet pressed web made according to the present disclosure can be attached to one or more other fibrous webs for forming a tissue product having desired characteristics, such as improved bulk, good tensile strength and relatively low stiffness. The other webs laminated to the single-ply webs of the present disclosure can be, for instance, a wet-creped web, a calendered web, an embossed web, a through-air dried web, a creped through-air dried web, an uncreped through-air dried web, an airlaid web, and the like. In other embodiments two or more single-ply webs of the present disclosure are plied together to form a multi-ply tissue product.

The basis weight of tissue webs made in accordance with the present disclosure can vary depending upon the final product. For example, the process may be used to produce bath tissues, facial tissues, paper towels, and the like. In general, the basis weight of the tissue web may vary from about 5 to about 50 gsm, such as from about 10 to about 40 gsm. Tissue webs may be converted into single and multi-ply bath or facial tissue products having basis weight from about 10 to about 80 gsm and more preferably from about 20 to about 50 gsm.

Multi-ply tissue products produced according to the present invention may have a GMT greater than about 500 g/3", such as from about 500 to about 900 g/3" and more preferably from about 600 to about 750 g/3". At these strengths, the tissue products generally have GM Slopes less than about 10 kg/3", such as from about 5 to about 9 kg/3", and in particularly preferred embodiments from about 6 to about 8 kg/3". The relatively slow GM Slope and modest GMT yield products having relatively low Stiffness Index, such as less than about 15, for example from about 8 to about 15 and in particularly preferred embodiments from about 10 to about 12. Further, the multi-ply products generally have improved sheet bulk compared to tissue products substantially free from agave fibers, such as sheet bulks at least about 10 percent greater and ranging from about 7.0 to about 10.0 cc/g.

In addition to having sufficient strength to withstand use and relatively low stiffness, the tissue webs and products of the present disclosure also have good bulk characteristics, regardless of the method of manufacture. For instance, conventional creped wet pressed tissue products prepared using treated fibers may have a sheet bulk greater than about 8 cc/g, such as from about 8 to about 15 cc/g and more preferably from about 10 to 12 cc/g. In other embodiments through-air dried tissue and more preferably uncreped through-air dried tissue comprising treated fibers have a sheet bulk greater than about 10 cc/g, such as from about 10 to about 25 cc/g and more preferably from about 16 to about 22 cc/g.

The increase in bulk is particularly acute when the treated fiber is disposed in the center layer of a three layer structure. Surprisingly, the increase in bulk is accompanied by minimal degradation in strength and a decrease in the Stiffness Index. A comparison of various tissue webs illustrating this effect are shown in the table below. Accordingly, in certain preferred embodiments the present disclosure provides a tissue web having enhanced bulk and softness without a significant decrease in tensile, where the web has three layers—a first, a second and a third layer, wherein treated fibers are selectively disposed in the second layer and comprise from about 5 to about 50 percent, and more preferably from about 10 to about 30 percent of the weight of the web. In a particularly preferred embodiment the present disclosure provides a two-ply tissue product where each tissue ply comprises three layers with treated fibers selectively disposed in the middle layer, the tissue product having a GMT from about 600 to about 800 g/3", a sheet bulk greater than about 8 cc/g, such as from about 8 to about 12 cc/g and a Stiffness Index less than about 15, such as from about 8 to about 12.

In other embodiments the present disclosure provides a two-ply tissue product comprising an upper multi-layered tissue web and a lower multi-layered tissue web that are plied together using well-known techniques. The multi-layered webs comprise at least a first and a second layer, wherein treated fibers are selectively incorporated in only one of the layers, such that when the webs are plied together the layers containing the treated fibers are brought into contact with the user's skin in-use. For example, the two-ply tissue product may comprise a first and second tissue web, wherein the tissue webs each comprise a first and second layer. The first layer of each tissue web comprises wood fibers and treated fibers and, while the second layer of each tissue web is substantially free of treated fibers. When the tissue webs are plied together to form the tissue product the second layers of each web are arranged in a facing relationship such that the treated fibers are brought into contact with the user's skin in-use.

In other embodiments, tissue products produced according to the present disclosure have GMT greater than about 500 g/3", such as from about 500 to about 900 g/3" and more preferably from about 600 to about 750 g/3". At these strengths, the tissue products generally have GM Slopes less than about 10 kg/3", such as from about 5 to about 9 kg/3", and in particularly preferred embodiments from about 6 to about 8 kg/3". The relatively slow GM Slope and modest GMT yield products having relatively low Stiffness Index, such as less than about 15, for example from about 8 to about 15 and in particularly preferred embodiments from about 10 to about 12.

Test Methods

Sheet Bulk

Sheet Bulk is calculated as the quotient of the dry sheet caliper expressed in microns, divided by the bone dry basis weight, expressed in grams per square meter (gsm). The resulting Sheet Bulk is expressed in cubic centimeters per gram. More specifically, the Sheet Bulk is the representative caliper of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm). The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

EXAMPLES

Treated fibers were prepared from eucalyptus hardwood kraft (EWHK) pulp fibers by first dispersing 10 g of EHWK fibers in 1,000 g of water and mechanically blending using a mixer to form a uniform slurry. To the EHWK fiber slurry, a first reagent (specific compound and amount set forth in Table 1, below) was added and mixed for 5 minutes to form a treated fiber slurry. After mixing, the treated fiber slurry was placed into an oven at 90° C. and dried for several hours until the treated fiber slurry reached a fiber consistency of about 15 percent. The partially dried modified fiber was then mixed with a precipitation agent (specific compound and amount set forth in Table 1, below) under constant agitation for about 30 minutes to yield a treated EHWK fiber. The treated EHWK fiber was then washed with water to remove the byproduct of the reactants and then placed in a 110° C. oven for 2 hours to yield a dried treated EHWK fiber.

TABLE 1

| Sample Code | First Reagent (g) | Precipitation Agent (g) |
|---|---|---|
| HC-01 | 20% Sodium Silicate (100 g) | 10% Solution HCl (100 g) |

The treated fiber prepared as described above was subjected to further treatment by dispersing 10 g of HC-01 treated fiber in water to form a slurry having a consistency of about 15 percent. Approximately 0.1 g of 0.5% sodium hexametaphosphate was mixed into the HC-01 fiber slurry and then tetraethyl orthosilicate (TEOS) was added together with ethanol (5 g) as described in Table 2, below. After mixing for about 5 minutes, ammonia was added to trigger hydrolysis of TEOS. Mixing continued for another 60 minutes while the mixture was heated to 90° C. The twice treated EHWK fiber was then washed with water to remove the byproduct of the reactants and then placed in a 110° C. oven for 2 hours to yield a dried treated EHWK fiber.

TABLE 2

| Sample Code | Second Reagent (g) | Precipitation Agent (g) |
|---|---|---|
| HC-02 | Tetraethyl Orthosilicate (TEOS) (20 g) | 10% Solution $NH_3$ (2 g) |

TABLE 2-continued

| Sample Code | Second Reagent (g) | Precipitation Agent (g) |
|---|---|---|
| HC-04 | Tetraethyl Orthosilicate (TEOS) (10 g) | 10% Solution $NH_3$ (2 g) |

The HC-01 was also subject to further modification by dispersing 10 g of HC-01 treated fiber in water to form a slurry having a consistency of about 15 percent. Approximately 0.1 g of 0.5% sodium hexametaphosphate was mixed into HC-01 fiber slurry and then hydroxyl silicone oil (Mw of about 3,000) was added to the fiber slurry along with ethanol (5 g) as indicated in Table 3, below. After mixing for about 5 minutes, a solution of NaOH was added. Mixing continued for another 60 minutes while the mixture was heated to 90° C. The twice treated EHWK fiber was then washed with water to remove the byproduct of the reactants and placed in a 110° C. oven for 2 hours to yield a dried treated EHWK fiber.

TABLE 3

| Sample Code | Second Reagent (g) | Precipitation Agent (g) |
|---|---|---|
| HC-06 | Hydroxy silicone oil (10 g) | 50% Solution NaOH (50 g) |

Treated pulps prepared as described above were used to form handsheets. Handsheets were prepared using a lab handsheet former (Retention & Drainage Analyzer, GE-RDA-T6, commercially available from GIST Co., Ltd., Daejeon, Korea). The pulp (untreated or treated) was mixed with distilled water to form slurries at a ratio of 25 g pulp (on dry basis) to 2 L of water. The pulp/water mixture was subjected to disintegration using an L&W disintegrator Type 965583 for 5 minutes at a speed of 2975±25 RPM. After disintegration the mixture was further diluted by adding 4 L of water. Handsheets were formed using the wet laying handsheet former followed by pressing using opposed sheets of blotter paper on each side of the handsheet at a pressure of 98 psi for one minute and then a two minute contact on a hot surface to dry the handsheet. The dried handsheet was then cut into a 7.5×7.5 inch sample prior to physical testing. The physical properties of the handsheets are reported in Table 4, below.

TABLE 4

| Fiber Type | Caliper (mm) | Density (g/cc) | Basis Weight (gsm) |
|---|---|---|---|
| Untreated EHWK | 0.16 | 0.352 | 54.5 |
| HC-01 | 0.41 | 0.157 | 63.4 |
| HC-02 | 0.59 | 0.109 | 63.6 |
| HC-04 | 0.45 | 0.106 | 47.6 |
| HC-06 | 0.38 | 0.149 | 56.6 |

The silicon content of various fiber (treated and untreated) was assessed by weighing approximately 0.5 g of each fiber sample into a digestion vessel. Five milliliters of concentrated nitric acid and 1 mL of concentrated hydrofluoric acid were added then digested in a CEM microwave extractor. The silicon was determined by Inductively Coupled Plasma Optical Emissions Spectroscopy, ICP-OES using FIB-W003 "Guidelines for Metal Analysis by Inductive Coupled Plasma (ICP) Spectroscopy" with a CCV standard, which was within 11 percent. The results are reported in Table 5, below.

TABLE 5

| Sample ID | Silicon (ppm) |
|---|---|
| Unmodified EHWK | 721 |
| HC-01 | 9,347 |
| HC-02 | 20,868 |
| HC-04 | 17,246 |
| HC-06 | 9,464 |

While treated fibers and methods of preparing the same, as well as tissue webs and products comprising treated fibers, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a method of manufacturing a treated fiber comprising the steps of providing a fiber slurry having a consistency equal to, or greater than, about 15 percent; adding a first reagent selected from the group consisting of a silicate, a silyl, a silane, and an alkaline metal to the fiber slurry, and adding a precipitation agent to the fiber slurry to form a treated fiber comprising a water-insoluble inorganic.

In a second embodiment the present invention provides the method of the first embodiment wherein the first reagent is a water-soluble compound having a water solubility of greater than about 100 mg/mL at 25° C.

In a third embodiment the present invention provides the method of the first or second embodiments wherein the first reagent is a silicate or an alkaline metal.

In a fourth embodiment the present invention provides the method of the first or second embodiments wherein the first reagent is a silicate selected from the group consisting of sodium silicate, potassium silicate, lithium silicate and quaternary ammonium silicates.

In a fifth embodiment the present invention provides the method of the first or second embodiments wherein the first reagent is a sodium silicate having a $SiO:Na_2O$ ratio from about 2:1 to about 4:1.

In a sixth embodiment the present invention provides the method of the first or second embodiments wherein the first reagent is a silane selected from the group consisting of a tetramethoxysilane, tetraethoxysilane (TEOS), tetrapropoxysilane, tetraisopropoxy silane, or combinations thereof.

In a seventh embodiment the present invention provides the method of any one of the first through sixth embodiments wherein the treated fiber comprises at least about 5,000 ppm water-insoluble inorganic selected from silicone, aluminum and zinc and combinations thereof.

In an eighth embodiment the present invention provides the method of any one of the first through seventh embodiments wherein at least about 75 percent of the water-insoluble inorganic is retained when the fiber is dispersed in water at 20° C.

In a ninth embodiment the present invention provides a treated fiber prepared by any one of the methods of the first through eighth embodiments.

In a tenth embodiment the present invention provides treated fiber comprising a fiber and a water-insoluble inorganic selected from the group consisting of silicon, aluminum and zinc, or combinations thereof, disposed thereon, where the amount of water-insoluble inorganic retained by the treated fibers is about 2.0 kilograms per metric ton of fiber or greater when the fiber is dispersed in water at 20° C.

In an eleventh embodiment the present invention provides the treated fiber of the tenth embodiment wherein the fiber is a hardwood fiber selected from the group consisting of eucalyptus, maple, birch, aspen, and combinations thereof.

In a twelfth embodiment the present invention provides the treated fiber of the tenth or eleventh embodiments wherein the treated fiber comprises at least about 1,000 ppm water-insoluble inorganic.

In a thirteenth embodiment the present invention provides the treated fiber of any one of the tenth through twelfth embodiments wherein the treated fiber comprises from about 5,000 to about 50,000 ppm water-insoluble inorganic.

We claim:

1. A method of increasing the bulk of a tissue web comprising the steps of:

a. dispersing a first fiber in an aqueous solvent to form a fiber slurry,
b. adding a first reagent selected from the group consisting of a silicate, a silyl, a silane, and an alkaline metal to the first fiber slurry,
c. partially dewatering the first fiber slurry to a consistency equal to, or greater than, about 15 percent to form a partially dewatered fiber slurry,
d. adding a precipitation agent to the partially dewatered first fiber slurry to form a treated fiber comprising a water-insoluble inorganic; and
e. forming a tissue web from the treated fiber, wherein the tissue web has a sheet bulk greater than about 5.0 cc/g and a basis weight less than about 60 gsm.

2. The method of claim 1 wherein the partially dewatered first fiber slurry has a consistency from about 20 to about 40 percent.

3. The method of claim 1 wherein the first reagent is a water-soluble compound having a water solubility of greater than about 100 mg/mL at 25° C.

4. The method of claim 3 wherein the water-soluble compound is a silicate or an alkaline metal.

5. The method of claim 3 wherein the water-soluble compound is a silicate selected from the group consisting of sodium silicate, potassium silicate, lithium silicate and quaternary ammonium silicates.

6. The method of claim 3 wherein the water-soluble compound is a sodium silicate having a $SiO:Na_2O$ ratio from about 2:1 to about 4:1.

7. The method of claim 1 wherein the first reagent is either a silane or a silyl.

8. The method of claim 1 wherein the first reagent is a silane selected from the group consisting of a tetramethoxysilane, tetraethoxysilane (TEOS), tetrapropoxysilane, tetraisopropoxy silane, or combinations thereof.

9. The method of claim 1 wherein the treated fiber comprises at least about 5,000 ppm water-insoluble inorganic selected from group consisting of silicone, aluminum and zinc.

10. The method of claim 1 wherein at least about 75 percent of the water-insoluble inorganic is retained when the treated fiber is dispersed in water at 20° C.

11. The method of claim 1 wherein the tissue web has a basis weight from about 10 to about 60 gsm and a sheet bulk greater than about 10 cc/g.

12. The method of claim 1 wherein the amount of treated fiber is from about 5 to about 80 percent of the weight of the web.

13. The method of claim 1 wherein the bulk of the tissue web is at least about 25 percent greater than the bulk of a similarly manufactured tissue web substantially free from treated fiber.

14. The method of claim 1 wherein the first fiber is a hardwood fiber.

15. The method of claim 1 wherein the web is a multi-layered web having a first outer layer, a second outer layer and a middle layer disposed there between and the treated fiber is selectively disposed in the middle layer.

16. The method of claim 15 wherein the first fiber is a hardwood fiber and the middle layer comprises from about 10 to about 30 percent, by weight of the web, treated fiber.

* * * * *